US005927500A

United States Patent [19]

Godfrey et al.

[11] Patent Number: 5,927,500

[45] Date of Patent: Jul. 27, 1999

[54] PHARMACEUTICAL CONTAINMENT PACKAGE

[75] Inventors: Thomas E. Godfrey, Moore; Christopher T. Usher, Greer; Eric Knauss, Greenville; Wayne G. Mason, Sr., Spartanburg, all of S.C.

[73] Assignee: Milliken & Company, Spartanburg, S.C.

[21] Appl. No.: 09/094,006

[22] Filed: Jun. 9, 1998

[51] Int. Cl.[6] ..... B65D 83/04

[52] U.S. Cl. ..... 206/531; 206/532; 206/461; 206/538

[58] Field of Search ..... 206/531, 532, 206/538, 461, 469

[56] References Cited

U.S. PATENT DOCUMENTS

| | | | |
|---|---|---|---|
| 3,895,158 | 7/1975 | Gause et al. | 428/220 |
| 4,429,792 | 2/1984 | Machbitz | 206/531 |
| 4,537,312 | 8/1985 | Intini | 206/531 |
| 4,838,425 | 6/1989 | O'Brien et al. | 206/531 |
| 4,889,236 | 12/1989 | Bartell et al. | 206/531 |
| 5,014,851 | 5/1991 | Wick | 206/531 |
| 5,052,558 | 10/1991 | Carter | 206/439 |
| 5,067,611 | 11/1991 | Hagmann et al. | 206/383 |
| 5,109,984 | 5/1992 | Romick | 206/531 |
| 5,791,478 | 8/1998 | Kalvelage et al. | 206/531 |

*Primary Examiner*—Paul T. Sewell
*Assistant Examiner*—J. Mohandesi
*Attorney, Agent, or Firm*—Terry T. Moyer; Earle R. Marden

[57] ABSTRACT

An improved pharmaceutical containment package is provided. The containment package includes a blister card disposed between a cover and a backing. At least one of the cover or the backing is a composite structure including a surface layer, a reinforcing fabric substrate layer in underlying relation to the surface layer and a layer of polymeric adhesive disposed between the surface layer and the reinforcing fabric substrate.

7 Claims, 1 Drawing Sheet

PHARMACEUTICAL CONTAINMENT PACKAGE

FIELD OF THE INVENTION

This invention relates generally to pharmaceutical packaging structures and more particularly concerns a fabric reinforced packaging material useful in covering relation to a blister pack containment structure.

BACKGROUND AND SUMMERY OF THE INVENTION

Pharmaceutical agents in the form of tablets and capsules are generally dispensed to users in packages of two types. The first type of packaging which has historically dominated the market is bulk packaging which generally takes the form of a small vial or bottle having a cap which either twists or pops away from the body of the containment article so as to provide access to the articles disposed therein. Such caps may include locking structures when engaged with the package body so as to prohibit access to the contents by children.

One deficiency with bulk packaging is that the user is responsible for maintaining an independent record by human memory or other means as to whether or not the proper dosage has actually been administered. This deficiency is particularly problematic for users who suffer from weak short-term memory performance. Thus, one can easily take either too many or too few doses in a given period of time thereby either reducing the efficiency of the medication, or in a more serious situation actually causing damage to one's system.

In order to address the inherent deficiencies of traditional bulk storage containers, a second category of storage systems referred to as blister packaging has been developed. Such blister packaging typically consists of individualized packets for each dose or fractional dose of the pharmaceutical agent located together on a card. This card is printed with a designation of dosages and warnings. The tablets themselves are encased between two materials such as aluminum foil and polyvinyl chloride film such that the tablet can be pressed through the aluminum foil backing thereby leaving a broken blister indicating that that dose has been utilized. As will be appreciated, while the use of a blister pack solves the problem of one being unable to remember whether or not a dosage has been administered, a paper card in combination with a necessarily easily opened foil barrier may be susceptible to damage due to tearing or child intrusion.

The present invention provides a packaging material which includes a paperboard or polymer sheet stock reinforced with a fabric substrate layer thereby providing a composite which is resistant to tearing. The present invention thus represents a useful advancement over the prior art.

SUMMARY OF THE INVENTION

In light of the foregoing, it is a general object of the present invention to provide an outer packaging layer for pharmaceutical blister packages having enhanced tear resistance.

In accordance with the general object of the invention, it is a feature of the present invention to provide a composite of paperboard or polymer sheet stock layered with a reinforcing fabric substrate.

It is an additional feature of the present invention to provide a composite material for use as the outer packaging for a blister pack structure which includes a fabric adhered to paperboard or polymer sheet stock using a thermoplastic extrudable polymer.

It is yet a further feature of the present invention to provide a composite for use as the outer packaging material for a blister package which includes a layer of fabric adhered to a paperboard or polymer sheet stock using a layer of thermoplastic polymer with a second layer of a polymer of either the same or different character being disposed across the fabric thereby providing a means to heat seal two such cards to one another around their perimeter.

Additional objects features and advantages of the invention will be set forth in part in the description which follows, and in part will be obvious from the description, or may be learned by practice of the invention. It is to be understood that both the foregoing general description and the following detailed description of preferred embodiments are exemplary and explanatory only, and not to be viewed as in any way restricting the scope of the invention as set forth in the claims hereto.

BRIEF DESCRIPTION OF THE DRAWINGS

The accompanying drawings which are incorporated in and constitute a part of this specification illustrate one potentially preferred embodiment of the invention and together with the description serve to explain the principles of the invention wherein.

DESCRIPTION OF PREFERRED EMBODIMENTS

Reference will now be made in detail to a potentially preferred embodiment of the present invention, an example of which has been illustrated in the accompanying drawings. It is to be understood that it is in no way intended to limit the invention to such illustrated and described embodiments. On the contrary, it is intended to cover all alternatives, modifications and equivalents as may be included within the true spirit and scope of the invention as defined by the appended claims and equivalents thereto.

Figure 1:
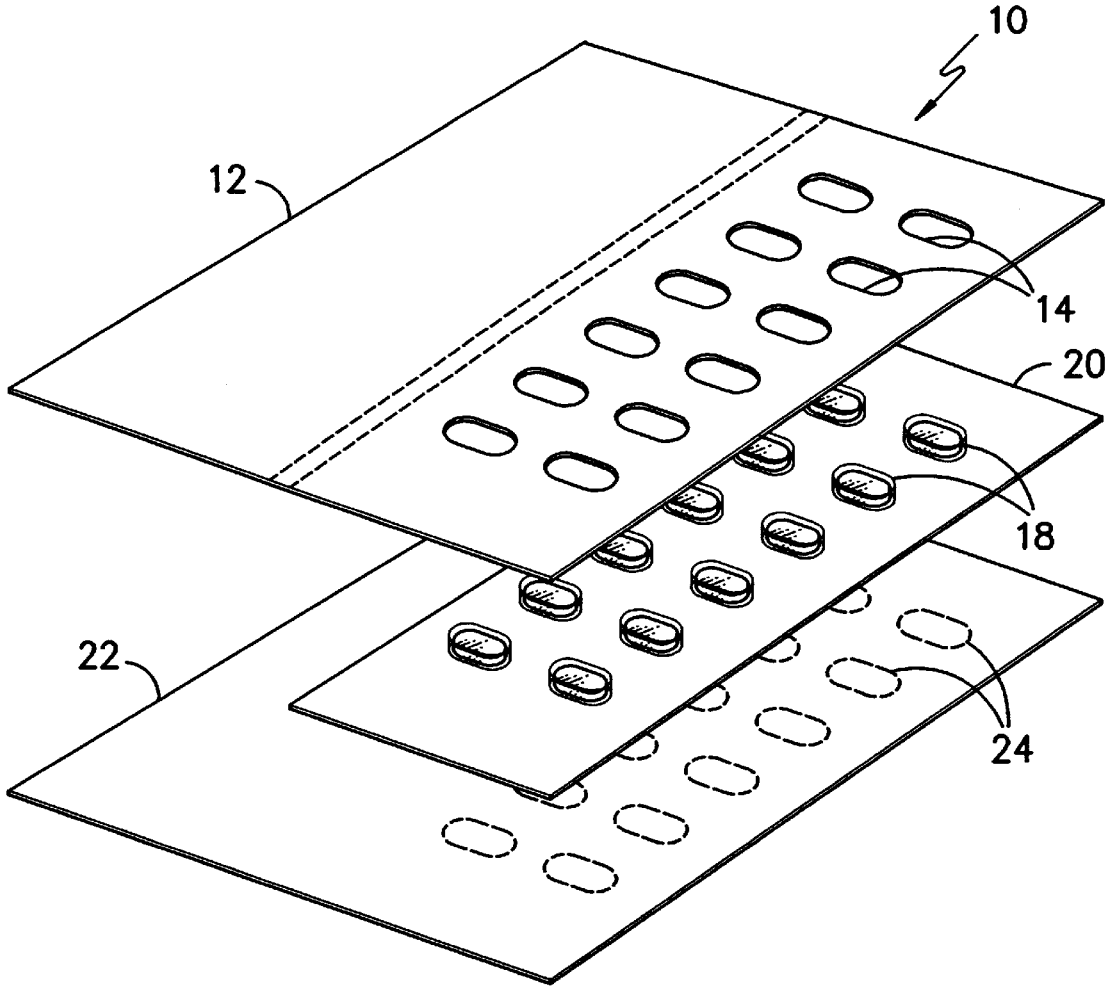
FIG. 1 illustrates an exploded perspective view of a pharmaceutical blister packaging structure and cover.

Turning now to the drawings, wherein like elements are denoted by like reference numerals throughout the various views, in FIG. 1 there is illustrated in exploded perspective view one embodiment of a pharmaceutical containment package 10 according to the present invention. As illustrated, the pharmaceutical containment package 10 preferably includes a cover layer 12 of printable material such as paperboard or polymer sheet stock which can be printed with messages and instructions regarding product identification, proper dosages, side effects, and emergency numbers. Potentially preferred polymer sheet stocks may be formed of PVC, polyolefins, polystyrene and blends thereof. In the illustrated and potentially preferred embodiment, the cover layer 12 includes a plurality of openings 14 disposed across its surface so as to provide visual and tactile access to the raised blisters 18 disposed across a blister card 20.

As will be appreciated by those of skill in the art, the blister card 20 is preferably formed by encapsulating tablets or capsules between two layers of material such as polyvinyl chloride film formed with raised blisters across an aluminum foil backing that encapsulates the tablet or capsule. The film is preferably substantially clear so as to permit the user to view the contents of the raised blisters 18. As will be further appreciated by those of skill in the art, the blister may be broken and the contents thereof accessed by exerting a downward force across the surface of the blister thereby causing the foil or other backing to shear away.

In the illustrated and potentially preferred embodiment of the present invention, the pharmaceutical containment package 10 will also include a backing card 22 in underlying relationship to both the cover layer 12 and the blister card 20. As illustrated, the backing card 22 preferably includes a plurality of perforated segments 24 disposed beneath the raised blisters 18. In practice, when the tablets or capsules disclosed within the raised blisters 18 are pressed through the foil backing of the blister card 20, the perforated segments 24 are opened across the backing card 22 thereby permitting access to the tablet or capsule. While the cover layer 12 and backing card 22 are illustrated as distinct separate components, it will, of course, be appreciated that these elements may be portions of a single sheet of material which is folded around the blister card 20. Likewise, in some applications either the cover layer 12 or the backing card 22 may be completely eliminated for purposes of simplifying the overall construction.

Figure 2:
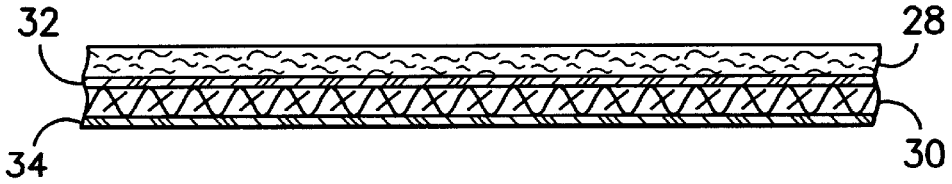
FIG. 2 is a cut-away view of the potentially preferred composite material utilized in forming the outer cover of the package illustrated in FIG. 1.

In FIG. 2, there is illustrated a cut-away view of the potentially preferred composite material utilized in forming at least one of the cover layer 12 or backing card 22. As illustrated, this composite material includes an exterior 28 of printable material such as paperboard or polymer sheet stock. In the event that polymer sheet stock is utilized, potentially preferred materials of construction include PVC, polyolefins, polystyrene and blends thereof. A fabric substrate 30 is disposed beneath the cover layer 28 as shown. In practice, the fabric substrate 30 is adhered to the cover layer 28 by a layer 32 of polymeric material as shown.

This layer 32 of polymeric material is preferably a low density polyethylene and more preferably may be a polyolefin copolymer including EVA (Ethylene-Vinyl Acetate Copolymer), EMA (Ethylene-Methyl Acrylate Copolymer), EEA (Ethylene-Ethyl Acrylate Copolymer), EM (Ethylene-Acrylic Acid Copolymer), EnbA (Ethylene-n-butyl Acrylate Copolymer) and blends thereof; the polymeric material may also be an lonomer resin; Polypropylene; Polyamide or copolymer thereof including Nylon and copolymers of Nylon; Polyester or Copolymer of Polyester including PET (Polyethylene Terephthalate), PBT (Polybutylene Terephthalate), PB (Poly Butylene) and blends thereof; a Flouropolymer such as PCTFE (Polychlorotrifluoroethylene) sold in film form under the Trade designation ACLAR by Allied Signal Corporation, ETFE (Ethylene-Tetrafluoroethylene) and blends of any of the above.

The fabric substrate may be of any known construction including woven, nonwoven, knit, warpknit, scrim, or stabilon constructions as are well known to those of skill in the art. Woven constructions may be particularly preferred.

The material of construction for the fabric substrate 30 is preferably selected from the group consisting of polypropylene, nylon including nylon-6 and nylon-6,6, polyester, polyolefins and glass. As will be appreciated, the fabric substrate 30 provides added stability and reinforcement to the cover layer 28 so as to enhance tear resistance.

In the illustrated and potentially most preferred embodiment, the composite material further includes a second layer 34 of extrudable polymer disposed across the second face of the fabric substrate 30. The group of materials from which the second layer 34 of polymer is preferably formed is the same as the grouping previously listed with respect to the first layer 32. However it is to be understood and appreciated that the first layer 32 and second layer 34 need not be identical to one another. Furthermore it is to emphasized that any listing of materials or constructions has been provided for exemplary purposes only and is not to be viewed as unduly limiting the scope of the invention herein.

In practice, when a composite structure as illustrated in FIG. 2 is utilized on one or both of the cover layer 12 and backing card 22 these elements can be adhered together around there peripheries by heat sealing using the second layer 34 of Thermoplastic polymer as the binding agent. As will be appreciated, this helps to prevent the cover layer 12 from being peeled away from the backing card 22, thereby exposing the blister card 20. Thus, through use of the fabric reinforced composite as advocated in the present invention, the pharmaceutical containment package may be provided with both enhanced tear resistance by the fabric substrate 30 as well as with enhanced resistance to delamination by heat sealing the polymer around the periphery.

While specific preferred embodiments and materials have been illustrated, described, and identified, it is to be understood that the invention is in no way limited thereto, since modifications may be made and other embodiments of the principles of this invention will occur to those of skill in the art to which this invention pertains. Therefore, it is contemplated to cover any such modifications and other embodiments as incorporate the features of this invention within the full lawful scope of allowed claims as follows.

What is claimed is:

1. A pharmaceutical package including a blister card and at least one cover layer of composite material, wherein, said composite material comprises: a printable surface layer, a reinforcing fabric substrate layer disposed in underlying relation to said printable surface layer and a first layer of polymeric adhesive disposed between said reinforcing fabric substrate layer and said printable surface layer.

2. The invention according to claim 1, wherein said at least one composite cover layer further comprises a second layer of polymeric adhesive disposed across the underside of said reinforcing fabric substrate layer.

3. The invention according to claim 2, where said first and second layers of polymeric adhesive are substantially identical.

4. A pharmaceutical package including a blister card disposed between a cover and a backing wherein at least one of said cover or said backing is a composite structure comprising: a surface layer, a reinforcing fabric substrate layer disposed in underlying relation to said surface layer, a first layer of polymeric adhesive disposed between said reinforcing fabric substrate and said surface layer and a second layer of polymeric adhesive disposed across the underside of said reinforcing fabric, and wherein said second layer of extrudable polymeric adhesive bonds said cover to said backing.

5. The invention according to claim 4, wherein said backing includes a plurality of perforated openings disposed across its surface.

6. The invention according to claim 4, wherein the surface layer is paperboard.

7. The invention according to claim 4, wherein the surface layer is formed from a polymer sheet material selected from the group consisting of PVC, Polyolefins, Polystyrene, Polyester, Fluoropolymer Resin and blends thereof.

* * * * *